US008081907B2

(12) United States Patent
Ogino

(10) Patent No.: US 8,081,907 B2
(45) Date of Patent: Dec. 20, 2011

(54) DEVELOPER FEEDING APPARATUS AND DEVELOPING APPARATUS

(75) Inventor: Hiroki Ogino, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 535 days.

(21) Appl. No.: 12/265,294

(22) Filed: Nov. 5, 2008

(65) Prior Publication Data

US 2009/0123190 A1 May 14, 2009

(30) Foreign Application Priority Data

Nov. 8, 2007 (JP) ..... 2007-290813
Oct. 31, 2008 (JP) ..... 2008-281566

(51) Int. Cl.
*G03G 15/08* (2006.01)

(52) U.S. Cl. ..... 399/254; 399/258

(58) Field of Classification Search ..... 399/254, 399/256, 258, 263, 265, 267, 272, 279, 281; 476/51–53
See application file for complete search history.

(56) References Cited

U.S. PATENT DOCUMENTS

| | | | | |
|---|---|---|---|---|
| 2,461,258 | A * | 2/1949 | Brooks | 322/28 |
| 3,626,453 | A * | 12/1971 | Riley | 476/51 |
| 4,183,253 | A * | 1/1980 | Borello | 476/16 |
| 6,704,529 | B2 * | 3/2004 | Noh | 399/167 |
| 6,775,503 | B2 * | 8/2004 | Hattori et al. | 399/258 |
| 2004/0033083 | A1 * | 2/2004 | Fukuyama et al. | 399/53 |

FOREIGN PATENT DOCUMENTS

| | | | |
|---|---|---|---|
| JP | 64-84266 | A | 3/1989 |
| JP | 1-161385 | A | 6/1989 |
| JP | 2001-166591 | A | 6/2001 |
| JP | 2006-194980 | A | 7/2006 |
| JP | 2006194980 | A * | 7/2006 |

* cited by examiner

*Primary Examiner* — Robert Beatty
(74) *Attorney, Agent, or Firm* — Fitzpatrick, Cella, Harper & Scinto

(57) ABSTRACT

Cones whose rotation axes are substantially parallel to each other and whose sides maintain a constant interval therebetween are provided in a driving force transmission unit to transmit a driving force to a developer feeding member, a roller to transmit the driving force is provided between the cones, a position of the roller is moved in accordance with rotation of one cone or the other, and a rotational speed of the developer feeding member to which the driving force is transmitted from one cone changes with an increase in a number of revolutions of s driving force transmission unit.

8 Claims, 5 Drawing Sheets

DEVELOPER FEEDING APPARATUS AND DEVELOPING APPARATUS

BACKGROUND OF THE INVENTION

1. Field of the Invention

The present invention relates to a developer feeding apparatus and a developing apparatus applied to an image forming apparatus.

2. Description of the Related Art

Conventionally, an image forming apparatus using an electrophotographic image forming process adopts a process cartridge system in which an electrophotographic photosensitive member and a process unit acting on the electrophotographic photosensitive member are integrated into a cartridge and the cartridge is made removable from the main body of the image forming apparatus.

According to the process cartridge system, the apparatus can be maintained by the user himself (herself) without relying on maintenance personnel and thus, operability can significantly be improved. Therefore, the process cartridge system is widely used in electrophotographic image forming apparatuses.

A developer feeding apparatus is integrated in this kind of process cartridge to feed a developer (toner) to a developing roller by a developer feeding member (toner feeding member) provided in the developer feeding apparatus being rotated.

Some developer feeding apparatuses have a unit for changing the rotational speed of the toner feeding member by which the number of revolutions of a motor is controlled in accordance with a remaining amount of toner to change the number of revolutions of the toner feeding member (Japanese Patent Application Laid-Open No. 01-84266).

SUMMARY OF THE INVENTION

An object of the present invention is to further develop conventional technology to change the rotational speed of the toner feeding member with stability using a simple configuration.

Another object of the present invention is to provide a developer feeding apparatus including a developer feeding member rotatably provided to feed a developer and a driving force transmission unit for transmitting a driving force to the developer feeding member, wherein the driving force transmission unit includes a first driving force transmission member rotatably provided with a first rotation axis and having a first conic surface inclined toward the first rotation axis to have the driving force transmitted from a drive source, a second driving force transmission member rotatably provided with a second rotation axis parallel to the first rotation axis and having a second conic surface inclined toward the second rotation axis with a constant interval to the first conic surface to transmit the driving force to the developer feeding member, a third driving force transmission member rotatably provided in pressure-contact with each of the first conic surface and the second conic surface to transmit the driving force between the first driving force transmission member and the second driving force transmission member, and a moving unit for enabling the third driving force transmission member to move so that a size of a diameter of the first conic surface at a position in pressure-contact with the third driving force transmission member and that of the second conic surface at a position in pressure-contact with the third driving force transmission member change in accordance with rotation of the first driving force transmission member or the second driving force transmission member, wherein a rotational speed of the developer feeding member changes in accordance with an increase in number of revolutions of the first driving force transmission member by the third driving force transmission member being moved by the moving unit in accordance with rotation of the first driving force transmission member or the second driving force transmission member.

DESCRIPTION OF THE EMBODIMENTS

An optimal embodiment to carry out the present invention will exemplarily be described below in detail with reference to drawings. However, dimensions, materials, and shapes of components and relative configuration thereof are to be suitably changed depending on the configuration of apparatus to which the present invention is applied and various conditions and do not limit the scope of the present invention to the embodiment below. If not specifically described, materials, shapes and the like once described in a description that follows will be the same ones as those in the first description.

In a description that follows, the longitudinal direction is a direction crossing a direction in which a process cartridge is inserted into and removed from the main body of apparatus (a direction substantially perpendicular to, an axis direction of an image bearing member) and a direction parallel to the surface of a recording material and crossing (substantially perpendicular to) the conveying direction of the recording material. Left or right means to the left or right when a recording material is viewed from above according to the conveying direction of the recording material. The top surface of a process cartridge is a surface positioned above after the process cartridge is inserted into the main body of apparatus and the undersurface is a surface positioned below.

(Description of a Whole Electrophotographic Image Forming Apparatus)

First, the overall configuration of an electrophotographic image forming apparatus (hereinafter, referred to as the image forming apparatus) will be described in outline with reference to FIG. 2.

Here, the electrophotographic image forming apparatus is an apparatus that forms an image on a recording material using an electrophotographic image forming system and includes, for example, an electrophotographic copier, electrophotographic printer (for example, a laser beam printer and LED printer), facsimile machine, and word processor.

Figure 2:
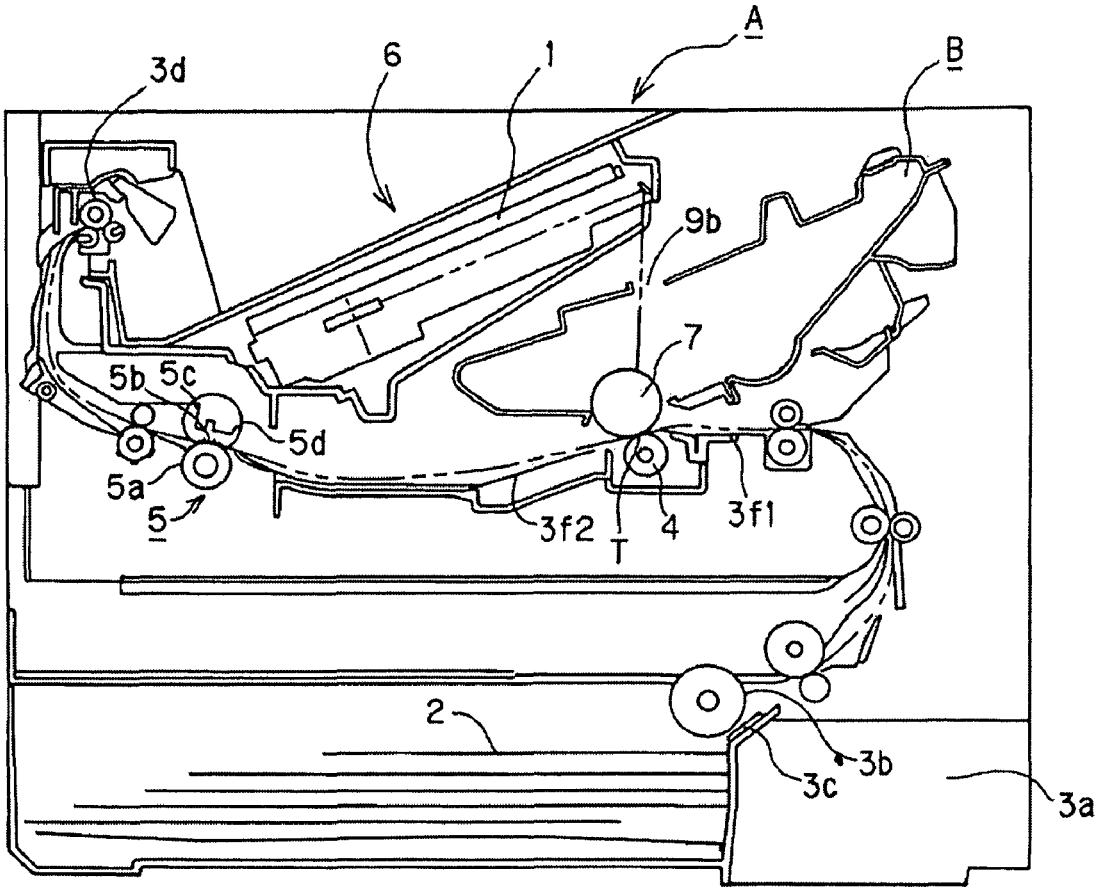
FIG. 2 is a schematic sectional view showing the outline configuration of an image forming apparatus according to an embodiment of the present invention.

FIG. 2 is a schematic sectional view of the image forming apparatus in which a process cartridge according to the present embodiment is inserted, and more specifically, a schematic sectional view of a laser beam printer, which is an embodiment of the image forming apparatus.

An image forming apparatus (laser beam printer) A according to the present embodiment irradiates a drum-shaped electrophotographic photosensitive member (hereinafter, referred to as the photosensitive drum) 7 as an image bearing member with information light based on image information from an optical system 1 as an optical unit to form an electrostatic latent image on the photosensitive drum 7. The electrostatic latent image is developed by a developer (hereinafter, referred to as toner) to form a toner image. In synchronization with formation of the toner image, a recording material (for example, a recording medium such as a recording paper, OHP sheet, and cloth) 2 is separated one by one for feeding from a cassette 3*a* by a pickup roller 3*b* and a pressure contact member 3*c* in contact therewith by pressure.

The fed recording material 2 is conveyed along a conveying guide 3*f*1 to a transfer part T where the photosensitive drum 7 of a process cartridge B and a transfer roller 4 as a transfer unit are opposite to each other.

The fed recording material 2 conveyed to the transfer part T has a toner image formed on the photosensitive drum 7 transferred by the transfer roller 4 to which a voltage is applied before being conveyed to a fixing unit 5 along a conveying guide 3*f*2.

The fixing unit 5 contains, in addition to a driving roller 5*a* and a heater 5*b*, a fixing rotator 5*d* constructed from a cylindrical sheet rotatably supported by a support medium 5*c* and applies heat and pressure to the passing recording material 2 to fix the transferred toner image.

A discharge roller 3*d* is constructed so that the recording material 2 to which toner image is fixed is conveyed through a reversal conveying path before being discharged to a discharge part 6. In the present embodiment, the conveying unit of a recording material includes the pickup roller 3*b*, the pressure contact member 3*c*, and the discharge roller 3*d*.

(Process Cartridge)

Figure 3:
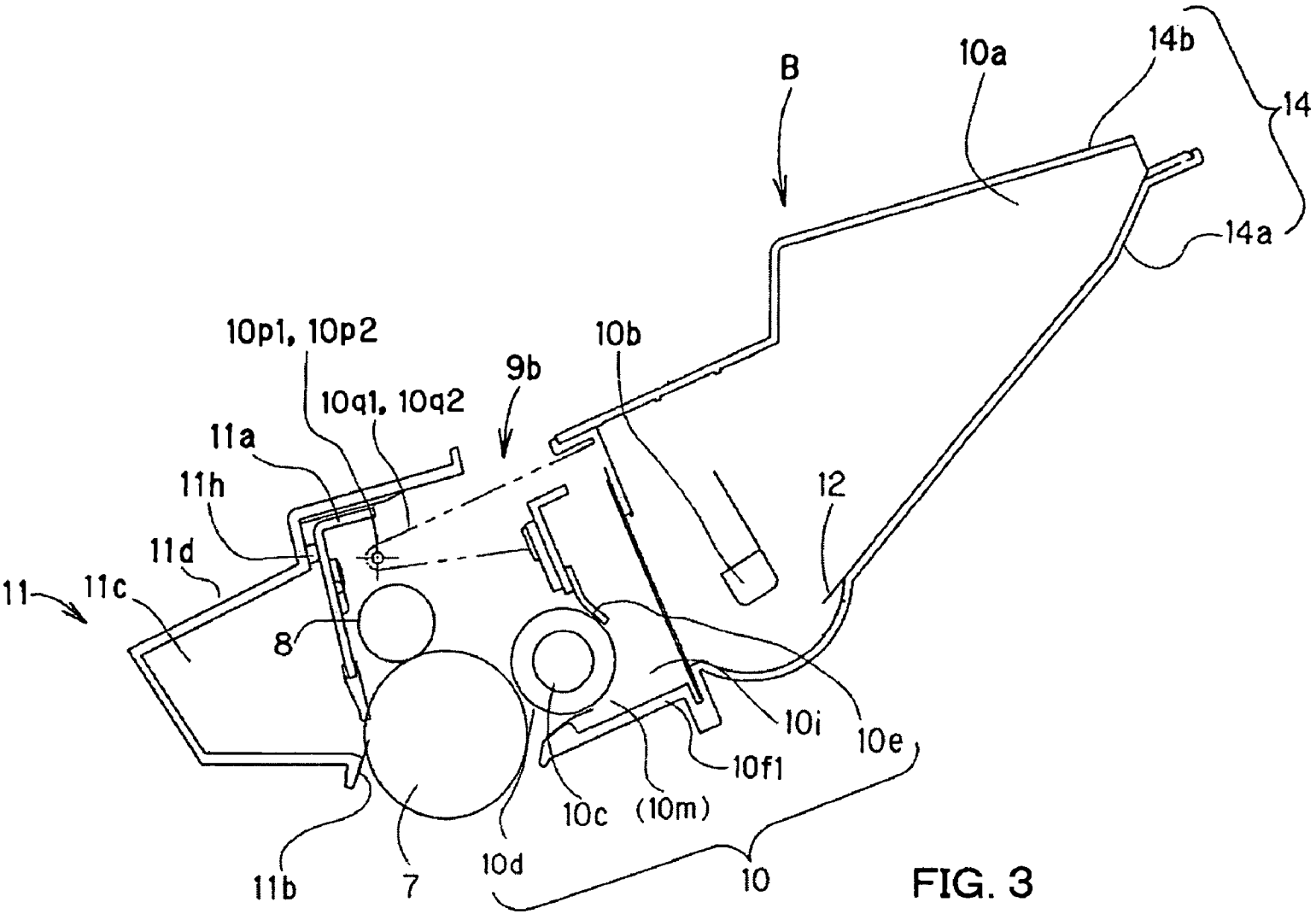
FIG. 3 is a schematic sectional view showing the outline configuration of a process cartridge according to an embodiment of the present invention.

Next, the overall configuration of a process cartridge will be described in outline with reference to FIG. 3. FIG. 3 is a schematic sectional view of a process cartridge according to the present embodiment.

As shown in FIG. 3, the process cartridge B has the photosensitive drum 7 and at least one process unit. Here, the process unit includes, for example, a charging unit for charging the photosensitive drum 7, a developing unit for developing an electrostatic latent image formed on the photosensitive drum 7, and a cleaning unit for cleaning toner remaining in the photosensitive drum 7.

The process cartridge B according to the present embodiment is constructed to include the photosensitive drum 7 having a photosensitive layer, a charging roller 8 as a charging unit, and a developing unit 10 as a developing apparatus. As an operation of the process cartridge B, the photosensitive drum 7 is first rotated and a voltage is applied to the charging roller 8 to uniformly charge the surface of the photosensitive drum 7. Then, information light (light image) based on image information from the optical system 1 is exposed to the charged photosensitive drum 7 through an exposure opening 9*b* to form an electrostatic latent image on the surface of the photosensitive drum 7 before the electrostatic latent image being developed by the developing unit 10 as a developing apparatus.

The developing unit 10 delivers toner inside a toner storage frame (toner storage part) 10*a* of a toner frame 14 as a developer storage part by a rotatable developer feeding member (hereinafter, referred to as the toner feeding member) 10*b* and an elastic sheet 12 that vibrates after interference within a rotation area of the toner feeding member 10*b*. Then, a developing roller 10*d* as a developing rotator (developer carrying member) containing a stationary magnet 10*c* is rotated and also a toner layer to which a frictional electrification charge is provided by a developing blade 10*e* is formed on the surface of the developing roller 10*d*. A toner image is formed and made a visible image by transferring the toner to the photosensitive drum 7 in accordance with the electrostatic latent image.

In FIG. 3, the toner feeding member 10*b* is shown as a combined member of a toner feeding rod and a sheet member, but is not limited to this configuration.

Then, the toner image is transferred to the recording material 2 by applying a voltage of the reverse polarity to that of the toner image to the transfer roller 4. After the transfer, residual toner on the photosensitive drum 7 is removed by a cleaning unit by which toner remaining on the photosensitive drum 7 is scraped off by a cleaning blade 11*a* and the toner is scooped up by a scoop sheet 11*b* and collected in a removed toner storage part 11*c*.

The process cartridge B according to the present embodiment includes a drum unit 11 and the developing unit 10. Here, the drum unit 11 rotatably supports the photosensitive drum 7 and includes a drum frame 11*d* in which the cleaning blade 11*a* and the charging roller 8 are incorporated. The developing unit 10 includes a developing frame 10*f*1 in which the developing roller 10*d* and the toner storage part 10*a* are incorporated. The developing frame 10*f*1 is rotatably supported with respect to the drum frame 11*d* so that the developing roller 10*d* can face the photosensitive drum 7 in parallel at predetermined intervals. Thus, spacing members (hereinafter, referred to as spacers) 10*m* to maintain an interval between the developing roller 10*d* and the photosensitive drum 7 are arranged at both ends of the developing roller 10*d*.

The developing frame 10*f*1 includes arm parts 10*q*1 and 10*q*2 in which connecting holes 10*p*1 and 10*p*2 for rotatably hanging the developing unit 10 including the developing roller 10*d* by the drum unit 11 including the cleaning blade 11*a* are formed. Moreover, a predetermined applied pressure is provided between the developing unit 10 and the drum unit 11 to maintain the interval.

Figure 1:
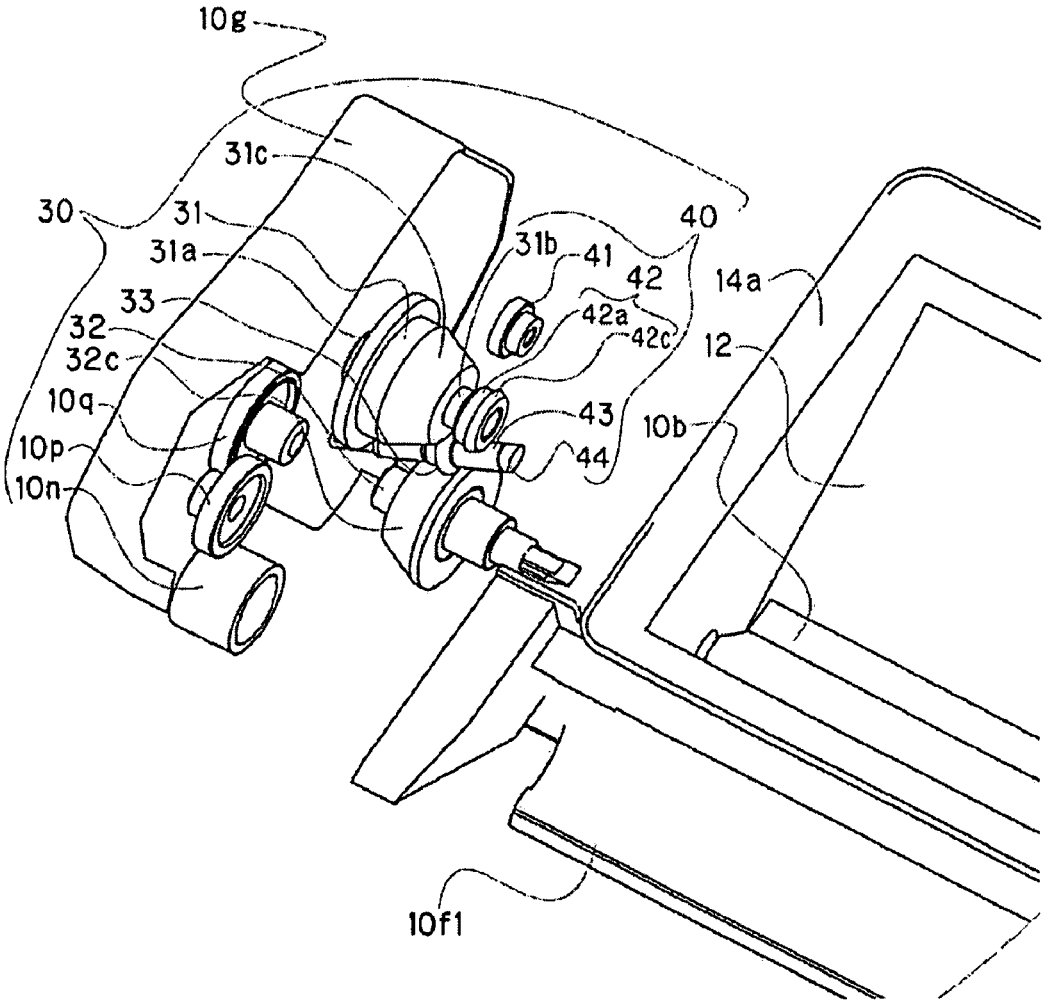
FIG. 1 is a schematic perspective view showing an outline configuration of a driving force transmission unit according to an embodiment of the present invention.

End members are provided at both ends of the developing frame 10*f*1 in the longitudinal direction. FIG. 1 shows an end member 10*g* of the end members.

The end member 10*g* wraps a developing roller gear 10*n*, idler gears 10*p* and 10*q*, a cone 31 as a first driving force transmission member, a cone 32 as a second driving force transmission member, a roller 33 as a third driving force transmission member, an idler gear 41, and a cone 42 (See FIG. 1).

Here, the idler gear 41 and the cone 42 constitute a speed change unit 40 as a driving force transmission part. The developing roller gear 10*n*, the idler gears 10*p* and 10*q*, the cones 31 and 32, the roller 33, and the speed change unit 40 constitute a driving force transmission unit 30. Then, the driving force transmission unit 30 and the toner feeding member 10*b* as the developer feeding member constitute a developer feeding apparatus.

The developing roller gear 10*n* is fixed to an end of the developing roller 10*d* engaging with a drum gear (not shown) fixed to an end of the photosensitive drum 7. The idler gears 10*p* and 10*q* are used to transmit a driving force from a drive source (not shown) from the developing roller gear 10*n* to the toner feeding member 10*b*. Here, the drive source is provided in the main body of the image forming apparatus A. The idler gear 41 is used to transmit a driving force from the cone 31 to a roller movable member 43 as a movable member.

(Method of Transmitting a Driving Force to the Toner Feeding Member)

Figure 4:
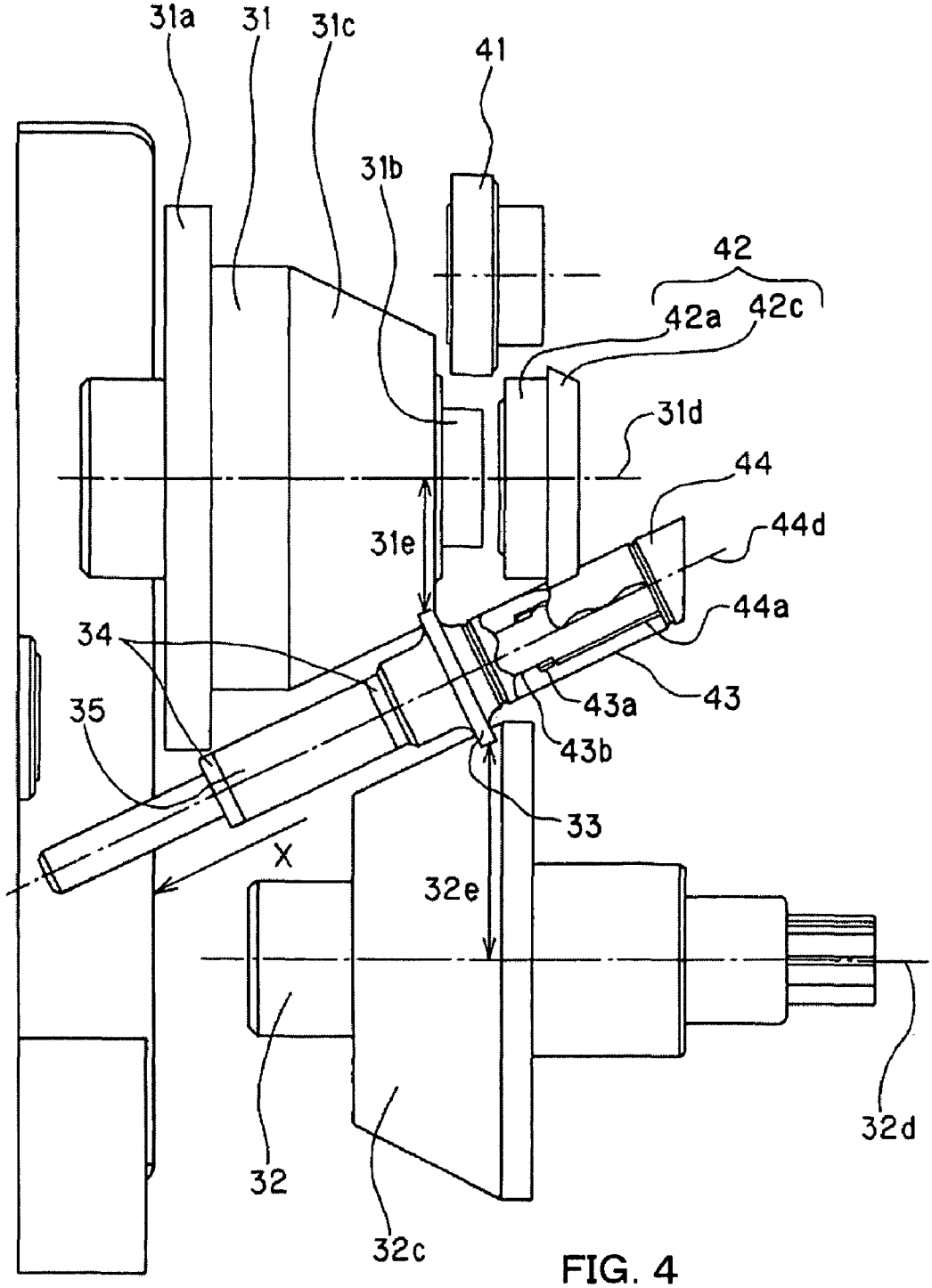
FIG. 4 is a schematic sectional view showing the outline configuration of the driving force transmission unit according to an embodiment of the present invention.

Next, the configuration of the driving force transmission unit 30 will be described more specifically with reference to FIGS. 1 and 4. FIG. 1 is a schematic perspective view showing the outline configuration of the driving force transmission unit 30 provided at an end of the developing unit 10 in the longitudinal direction. FIG. 4 is a schematic sectional view showing the outline configuration of the driving force transmission unit 30.

The cone 31 has a gear part 31*a* engaging with the idler gear 10*q*, a gear part 31*b* engaging with the idler gear 41 of the speed change unit 40, and a surface 31*c* provided in a substantially conic shape as a first conic surface, and rotates around a rotation center axis 31*d* as a first rotation axis. Here, the surface 31*c* is provided inclined toward the rotation center axis 31*d*.

The cone 32 is used to transmit a driving force to the toner feeding member 10*b*, is connected to the toner feeding member 10*b* in the present embodiment, has a surface 32*c* provided in a substantially conic shape as a second conic surface, and rotates around a rotation center axis 32*d* as a second rotation axis. Here, the surface 32*c* is provided inclined toward the rotation center axis 32*d*.

The rotation center axis 31*d* of the cone 31 and the rotation center axis 32*d* of the cone 32 are substantially parallel and the surface 31*c* of the cone 31 and the surface 32*c* of the cone 32 are provided substantially in parallel with each other so that the interval therebetween will be substantially constant.

The roller 33 is rotatably held to a roller axis 44 as an axis member provided substantially in parallel with the surfaces 31*c* and 32*c* so that the distance to the surface 31*c* of the cone 31 and that to the surface 32*c* of the cone 32 become substantially the same, and is in pressure-contact with the surfaces 31*c* and 32*c*. The rotation center axis of the roller 33 is the same as a center axis 44*d* of the roller axis 44.

The roller 33 is positioned by being pressed against an end face of the roller movable member 43 by a washer 34 provided on the roller axis 44 and a spring 35 as an energizing unit. Here, the washer 34 and the spring 35 constitute an interlocking unit for interlocking the roller 33 with a movement operation of the roller movable member 43 moving in the axis direction of the roller axis 44. Moreover, the roller movable member 43, the roller axis 44, the washer 34, and the spring 35 constitute a moving unit.

To transmit a driving force from the idler gear 10*q* to the toner feeding member 10*b*, the cone 31 is rotated by the driving force transmitted to the gear part 31*a* of the cone 31 to transmit the driving force to the roller 33 in pressure-contact with the surface 31*c* of the cone 31. Since the roller 33 is also in pressure-contact with the surface 32*c* of the cone 32, the driving force is transmitted to the cone 32 by the roller 33 being rotated so that the cone 32 rotates.

Since the cone 32 is coupled to the toner feeding member 10*b*, the driving force is transmitted by the cone 32 being rotated so that the toner feeding member 10*b* rotates.

(Method of Changing the Rotational Speed of the Toner Feeding Member)

Figure 5:
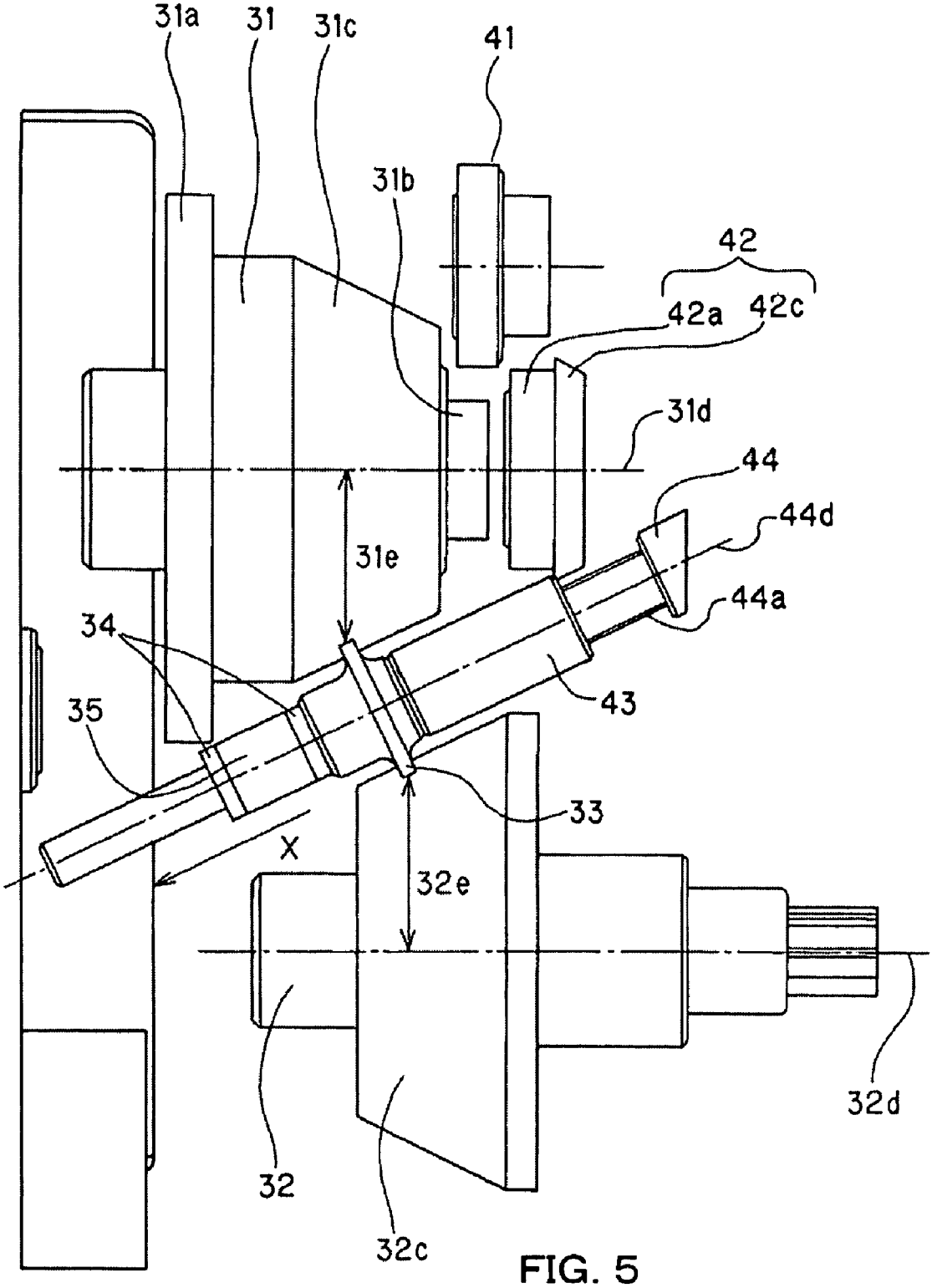
FIG. 5 is a schematic sectional view showing the outline configuration of the driving force transmission unit according to an embodiment of the present invention.

Next, the speed change unit 40 of the rotational speed of the toner feeding member 10*b* will be described more specifically with reference to FIGS. 1, 4, and 5. FIG. 5 is a schematic sectional view showing the outline configuration of the driving force transmission unit 30.

The cone 42 has a gear part 42*a* engaging with the idler gear 41 and a surface 42*c* in a substantially conic shape.

The roller movable member 43 is in pressure-contact with the surface 42*c* of the cone 42 and is rotatably held to the roller axis 44 by a sliding part 43*b* provided inside the roller movable member 43. Moreover, a screw part 43*a* as a second screw part provided at a different position from the sliding part 43*b* inside the roller movable member 43 and a screw part 44*a* as a first screw part of the roller axis 44 are provided so that both screw parts mesh (engage) with each other.

A driving force is transmitted to the roller movable member 43 as described below.

That is, the cone 42 is rotated by the driving force transmitted to the gear part 42*a* of the cone 42 via the idler gear 41 engaging with the gear part 31*b* of the cone 31 to transmit the driving force to the roller movable member 43 because the roller movable member 43 is in pressure-contact with the surface 42*c* of the cone 42. In this manner, the roller movable member 43 rotates in accordance with rotation of the cone 31 by the driving force being transmitted to the roller movable member 43.

The screw part 43*a* of the roller movable member 43 and the screw part 44*a* of the roller axis 44 are cut so that the roller movable member 43 moves in the X direction shown in FIG. 4 (axial direction of the roller axis 44) with a rotation operation of the roller movable member 43.

Therefore, the roller movable member 43 and the roller 33 pressed against the end face of the roller movable member 43 become movable in the X direction by rotation of the roller movable member 43 after a driving force is transmitted to the roller movable member 43.

Here, the rotational speed of the toner feeding member 10*b* is determined by a reduction ratio, which is a ratio of a contact part radius 31*e* of the cone 31 (the surface 31*c*) at a position in pressure-contact with the roller 33 and a contact part radius 32*e* of the cone 32 (the surface 32*c*) at a position in pressure-contact with the roller 33.

If the roller 33 gradually changes (moves) in the X direction from the initial (usage start) position shown in FIG. 4 with an increase in the number of revolutions of the driving force transmission unit 30 (for example, the cone 31), the contact part radii 31*e* and 32*e* of the cones 31 and 32 at a position in pressure-contact with the roller 33 change as follows: the contact part radius 31*e* of the cone 31 at a position in pressure-contact with the roller 33 gradually becomes larger and the contact part radius 32*e* of the cone 32 at a position in pressure-contact with the roller 33 gradually becomes smaller.

With changes described above, the reduction ratio determined by the cone 31 and the cone 32 gradually becomes smaller and thus, the rotational speed of the toner feeding member 10*b* becomes faster with an increase in the number of revolutions of the driving force transmission unit 30 (speedup).

After the roller 33 moves so far that the roller movable member 43 and the surface 42*c* of the cone 42 are no longer in contact (See FIG. 5), movement of the roller 33 and the roller movable member 43 in the X direction stops and the rotational speed of the toner feeding member 10*b* becomes constant.

In the present embodiment, as described above, the cones 31 and 32, whose rotation axes are substantially parallel to each other and whose sides maintain a constant interval therebetween, are provided in the driving force transmission unit 30 to transmit a driving force to the toner feeding member 10*b*, and the roller 33 to transmit the driving force is provided between the cone 31 and the cone 32. Then, the position of the roller 33 is moved in accordance with rotation of the cone 31 or the cone 32 and the rotational speed of the toner feeding member 10*b* to which a driving force is transmitted from the cone 32 becomes faster with an increase in the number of revolutions of the driving force transmission unit 30.

With the above configuration, the number of revolutions can be suppressed by reducing the rotational speed of the toner feeding member 10*b* when the rotational speed of the driving force transmission unit 30 is low, that is, the amount of toner in the toner storage part 10*a* is large. Thus, deterioration of toner can be reduced by suppressing stress on toner by the toner feeding member 10*b*.

As toner is consumed with an increase in the number of revolutions of the driving force transmission unit 30, the rotational speed of the toner feeding member 10*b* increases and thus, when a remaining amount of toner is small, the toner feeding member 10*b* can supply sufficient toner to the developing roller 10*d*.

Therefore, according to the present embodiment, the total number of revolutions of the toner feeding member 10*b* can be suppressed by the rotational speed of the toner feeding member 10*b* being changed with a simple configuration. Accordingly, deterioration of toner by the toner feeding member 10*b* can be reduced and image quality and the life of apparatus can be improved.

In the present embodiment, an example of an increasing rotational speed of the toner feeding member 10*b* is described, but the rotational speed of the toner feeding member 10*b* can be decreased by reversing the screw cutting. According to this, feeding capacities of toner when the use thereof is started can be improved.

A case in which the speed change unit 40 has a driving force transmitted from the cone 31 is described, but the present invention is not limited to this and the present invention can also be suitably applied, for example, when the speed change unit 40 has a driving force transmitted from the cone 32 or a known speed change mechanism is used as the speed change unit 40.

Also when the toner feeding member 10*b* shown in the above embodiment is a developer stirring member for stirring developer, like the present embodiment, the present invention can suitably be applied.

The process cartridge shown in the above embodiment is exemplified as a case in which a monochromatic image is formed, but the present invention is not limited to this. That is, a process cartridge according to the present invention can also be suitably applied when an image of a plurality of colors (for example, a two-color image, a three-color image or a full-color image) is formed by providing a plurality of developing units.

The electrophotographic photosensitive member is not limited to the photosensitive drum in the above embodiment and includes, for example, the following. First, a photoconductor is used as a photosensitive member and the photoconductor includes, for example, amorphous silicon, amorphous selenium, zinc oxide, titanium oxide, and organic photoconductors (OPC).

For example, a drum shape or belt shape is suitably applied as a shape to mount a photosensitive drum. Here, a drum type photosensitive member obtained by depositing or coating a photoconductor on a cylinder of aluminum alloy or the like can be exemplified.

Moreover, as a developing method, various known methods such as the two-component magnetic brush development, cascade development, touchdown development, and cloud development can be used.

The so-called contact electrification is used in the above embodiment as the configuration of the charging unit, but the present invention is not limited to this. Another configuration to be used may be obtained by applying a shield of metal such as aluminum around a conventionally used tungsten wire on three sides and applying a high voltage to the tungsten wire to move positive or negative resultant ions to the surface of the photosensitive drum to uniformly charge the surface of the drum.

The charging unit is not limited to the roller type shown in the above embodiment and may be a blade (charging blade), pad type, block type, rod type, and wire type.

As the cleaning method of toner remaining in the photosensitive drum, a cleaning unit may be constituted by using a blade, fur brush, magnetic brush and the like.

A process cartridge includes, for example, an electrophotographic photosensitive member and at least one process unit. Therefore, in addition to the above embodiment, embodiments shown below can be exemplified as aspects of the process cartridge. Such embodiments of the process cartridge include a cartridge created by integrating an electrophotographic photosensitive member and a developing unit to make the cartridge removable from the main body of an apparatus. Further, such embodiments of the process cartridge include a cartridge created by integrating an electrophotographic photosensitive member, a developing unit, and one of a charging unit and a cleaning unit to make the cartridge removable from the main body of an apparatus.

That is, the above process cartridge is a cartridge created by integrating at least a developing unit and an electrophotographic photosensitive member to make the cartridge removable from an image forming apparatus. Then, the process cartridge can be inserted into and removed from the main body of the apparatus by the user himself (herself). Therefore, the main body of the apparatus can be maintained by the user himself (herself).

Further, in the above embodiment, a laser beam printer is exemplified as an image forming apparatus, but the present invention is not limited to this. A developer feeding apparatus according to the present invention can suitably be applied, for example, to an electrophotographic copier, electrophotographic printer such as an LED printer, facsimile machine, and word processor, or an electrophotographic image forming apparatus such as a multifunctional machine (such as a multifunctional printer) of these apparatuses.

This application claims the benefit of Japanese Patent Application No. 2007-290813, filed on Nov. 8, 2007, and Japanese Patent Application No. 2008-281566, field on Oct. 31, 2008, which are hereby incorporated by reference in their entirety.

What is claimed is:

1. A developer feeding apparatus, comprising:

a developer feeding member rotatably provided to feed a developer; and a driving force transmission unit for transmitting a driving force to the developer feeding member, wherein the driving force transmission unit includes:

a first driving force transmission member rotatably provided with a first rotation axis and having a first conic surface inclined toward the first rotation axis to have the driving force transmitted from a drive source;

a second driving force transmission member rotatably provided with a second rotation axis parallel to the first rotation axis and having a second conic surface inclined toward the second rotation axis with a constant interval to the first conic surface to transmit the driving force to the developer feeding member;

a third driving force transmission member rotatably provided in pressure-contact with each of the first conic surface and the second conic surface to transmit the driving force between the first driving force transmission member and the second driving force transmission member; and a moving unit for enabling the third driving force transmission member to move so that a size of a diameter of the first conic surface at a position in pressure-contact with the third driving force transmission member and a size of a diameter of the second conic surface at a position in pressure-contact with the third driving force transmission member change in accordance with rotation of the first driving force transmission member or the second driving force transmission member, wherein the moving unit includes:

an axis member provided parallel to each of the first conic surface and the second conic surface to rotatably hold the third driving force transmission member; and a movable member rotatably provided with the axis member so as to be movable in an axial direction of the axis member with a rotation operation, wherein the third driving force transmission member is moved by the movable member being moved in the axial direction of the axis member by being rotated in accordance with rotation of the first driving force transmission member or the second driving force transmission member, wherein a rotational speed of the developer feeding member is changed in accordance with a change in a number of revolutions of the first driving force transmission member by the movement of the third driving force transmission member.

2. The developer feeding apparatus according to claim 1, wherein the moving unit includes:

an interlocking unit for interlocking the third driving force transmission member with a movement operation of the movable member moving in the axial direction of the axis member.

3. The developer feeding apparatus according to claim 2, wherein the moving unit includes:

a first screw part provided in the axis member; and a second screw part provided in the movable member to engage with the first screw part, wherein the movable member moves with respect to the axis member in the axial direction of the axis member when the movable member rotates in accordance with the rotation of the first driving force transmission member or the second driving force transmission member.

4. The developer feeding apparatus according to claim 3, wherein as the movable member moves with respect to the axis member in the axial direction of the axis member, the size of the diameter at a position where the third driving force transmission member is in pressure-contact becomes larger on the first conic surface and becomes smaller on the second conic surface.

5. The developer feeding apparatus according to claim 2, further comprising a driving force transmission part to transmit the driving force between the first driving force transmission member or the second driving force transmission member and the movable member.

6. The developer feeding apparatus according to claim 2, wherein the interlocking unit includes an energizing unit for energizing the third driving force transmission member toward the movable member.

7. A developing apparatus, comprising:

a developer carrying member;

a developer storage part for storing developer; and the developer feeding apparatus according to any of claims 1 to 6 to feed the developer stored in the developer storage part to feed the developer to the developer carrying member.

8. The developing apparatus according to claim 7, wherein the developing apparatus is removable from a main body of an image forming apparatus having the drive source.

* * * * *